United States Patent [19]

Polic

[11] Patent Number: 4,905,978

[45] Date of Patent: Mar. 6, 1990

[54] DEVICE FOR CORRECTING THE LATERAL POSITION OF A SHEET

[75] Inventor: Georges Polic, Prilly, Switzerland

[73] Assignee: Bobst SA, Switzerland

[21] Appl. No.: 299,871

[22] Filed: Jan. 19, 1989

[30] Foreign Application Priority Data

Jan. 20, 1988 [CH] Switzerland ..... 00191/88

[51] Int. Cl.[4] ..... B65H 5/22

[52] U.S. Cl. ..... 271/5; 271/90; 271/227

[58] Field of Search ..... 271/227, 90, 91, 5; 901/9, 47

[56] References Cited

U.S. PATENT DOCUMENTS 4,245,830 1/1981 Fichte et al. ..... 271/164

4,699,370 10/1987 Hashimoto ..... 271/227 X 4,708,759 11/1987 Porat ..... 271/227 X

*Primary Examiner*—Richard A. Schacher

*Attorney, Agent, or Firm*—Hill, Van Santen, Steadman, & Simpson

[57] ABSTRACT

A device for a pick-up unit for an infeed station of a processing machine which includes a carriage mounted in a main frame for shifting both laterally and vertically. The carriage is provided with a bar carrying several suction cups and is shifted laterally by a rack gear on the carriage being engaged by a pinion from a drive motor which rotates in response to the sensed lateral position of the sheet being lifted. The device is preferably used for centering sheets being picked up from a stack or pile of sheets within a feed station of a machine designed for converting or processing these sheets.

7 Claims, 3 Drawing Sheets

DEVICE FOR CORRECTING THE LATERAL POSITION OF A SHEET

BACKGROUND OF THE INVENTION

The present invention is directed to a device which enables correcting a lateral position of a sheet of material, such as a paper sheet or a box board sheet, as it is taken from a pile and before it is fit into a machine for further processing.

Certain machines, such as, for instance, printing or blank cutting machines, require a high position accuracy of a sheet being fed thereto, although the sheets are supplied in piles not always strictly vertical or else the pile is not always moved up to an infeed station exactly along a machine axis. Such machines usually include two stations upstream with regard to the grippers which seize the sheet one-by-one. These two stations include a feeder table which is preceded by a feeding or infeed station.

On the feeder table, a single sheet is simultaneously aligned on its front and lateral edges. The lateral alignment is achieved by means of two rollers nipping the edge and pulling the sheet sideways through a maximum distance of 8 mm. This maximum distance of 8 mm, thus, represents the maximum misalignment which is allowed for the sheet infeed on the feeder table through the infeed station.

The infeed station includes a pallet on which the sheets are piled up or on which are loaded with a pile previously built up owing to an intermediary, movable pallet. The four corners of the pallet are suspended on chains to enable the pallet to be hoisted during the departure of the sheets into the machine so that the top sheet on the pile remains at a constant level, as monitored by a photo-electric cell which is arranged adjacent the upper plane which is desired. This infeed station, moreover, includes a pickup unit which is arranged immediately above the plane of the top sheet. The purpose of this unit is to initially assure the lifting of the uppermost sheet solely and then its infeed into the feeder table.

To achieve these operations, the pick-up unit must, first, have lifting appliances arranged along a bar parallel to the upper sheet's front edge. In addition, the pick-up unit includes two more lifting suction cups designed for descending and being pressed onto the sheet, for seizing the sheet by means of an air vacuum built up within the cups, and for raising the sheet. For easy lifting of the sheet's front edge, two nozzles blow air against the sheet's rear edge. As soon as the sheet begins to lift off, a cam-actuated blower foot is applied on the rear edge of the sheet beneath the sheet being lifted.

The pick-up unit, secondly, is implemented with a carrier suction cup arranged on a crosswise bar perpendicular to the sheet travel direction and situated approximately in the sheet center area. This bar is held on the sheet of the pick-up unit by jointed or articulated arms. These arms are driven by the main machine's motor through a mechanical transmission assembly, which includes chains, cardan joints and cams, which are constructed and engineered in such a way that they can move the arms forward in order to push the sheet onto the feeder table, as required by the machine's operating cycle. Prior to this movement, the lifting suction cup will have released the sheet.

The frame of the pick-up unit is ordinarily mounted on the infeed station in such a way that its position, both vertically and in the sheet traveling direction, can be specifically adjusted to a pile of board or paper sheets of a given dimension.

As may be gathered from this arrangement, the precision of the sheet infeed position depends, to a large extent, on the initial pile position at this infeed station.

To this aim, various devices for pile position correction have, up to now, been developed. For instance, for this purpose, devices now being fitted by the assignee of the applicant on his machines, which device includes, on the one hand, a lever which, on one end, has a roller that follows successive positions of the upper sheets of the pile, whereas the other end actuates, when necessary, one of two switches corresponding to the pile shift to the right or left of the desired position. On the other hand, this device comprises an electric motor movable along a vertical column, which extends close to the lateral pallet edge and the threaded outlet axle of the motor is engaged in an aperture of the pallet. In this way, the motor moves along the column following the pallet and, depending on whether one or the other of the mentioned switches is switched on, turns the threaded axle in either a clockwise or counterclockwise direction, which will shift the pallet sideways in the desired direction to move it towards the desired orientation with respect to the infeed station.

According to a second device, which is described in U.S. Pat. No. 4,245,830, whose disclosure is incorporated by reference thereto, a mechanism for checking the registry of the upper lateral edge of the pile consists essentially of a sliding shoe provided with a metal flag activating two proximity detectors which are arranged horizontally, side-by-side. In this way, if the upper edge of the pile is in the desired position, the flag will have no influence on either of the detectors. However, if the pile has been shifted from the desired position, the flag will influence one of the detectors, which will simultaneously cause an electric motor to be actuated to adjust the lateral position of the pile to correct the detected misalignment.

These devices, which are designed for correcting the lateral pile position, have several drawbacks. In fact, the control of the upper pile edge subjected to a given measurement depends essentially on the repeatability of the detector switchoff, which might be jeopardized, by mechanical switches being either rubbed or being squeezed during the sensor movement. If, on the other hand, production speed is expected to be increased, beginning with a voluminous and large pile which has excessively been displaced, the motor is likely to have inadequate power to overcome the pile's mass inertia, which inertia will prevent the motor from correcting the position sufficiently quickly. Finally and especially, the sensors measure, generally, the medium position of the five or ten uppermost sheets of a pile, but do not detect a large, though exceptional, displacement of one of them causing substantially a full standstill of a single sheet of the group and this single misaligned sheet can cause a faulty alignment.

SUMMARY OF THE INVENTION

The present invention is directed to providing a device for correcting a sideways position of a sheet picked up from the top of a pile, which device overcomes the above-mentioned drawbacks and provides an infeed to the machine that will insure with a precision of +/−2 mm in a lateral position notwithstanding the production speed and without necessitating high precision for the positioning of the pile within the infeed station.

These objectives are obtainable with a device for sideways correcting of a sheet-shaped piece, such as a paper sheet or a board sheet, taken from a pile top by a pick-up unit in an infeed station of the machine. The pick-up unit includes a fixed frame having the pick-up unit with lifting appliances for picking up the piece from the pile disposed in the fixed frame and a conveying device, such as carrier suction cups, which move the piece within the machine after it has been released by the lifting appliance. The improvements include that the device has a movable carriage, which is provided with permanently fitted lifting devices and is shiftable in both a lateral and vertical direction, a first sensing arrangement or means to enable determination the lateral position of the sheet being lifted, a second sensing arrangement or means to allow a determining of the lateral position of the carriage, an arrangement or means for shifting the carriage vertically in accordance with the operating cycle of the machine, as well as means for shifting the carrier laterally in accordance with the indications of the first sensing means provided during an upward movement of the carriage and with shifting of the carriage during the downward movement of the carriage in response to the second sensing means to move the carriage back to the desired fixed or centered position.

It would be advantageous if the appliance enabling a vertical carriage shifting included two horizontal rails on which the carriage could move or slide sideways and which would be held in a parallel position by two end pieces, which are mounted on the ends of two axles, each of which are mounted on lateral sides of the fixed frame for sliding movement in bearings. Each of these axles is pushed downward by a biasing means, such as a spring which operates between the lower side of a frame mounting bearing and a shoulder on the axle or rod, and are pulled upward by a cam follower lever, which is pivotably mounted on the frame and has one end engaged with the axle and is provided with a follower engaging a rotary cam which is rotated by the machine's main drive motor so that the raising and lowering of the carriage is synchronized with the machine operating cycle.

Preferably, the improved apparatus includes a first electronics means for generating a speed command in accordance with the indication successively received from the first sensing means used for determining the position of the sheet and from the second sensing means, which indicates the lateral position of the carriage, and a second electronic means which receives an output from the first electronic means and generates a continuous electrical output in a linear fashion in line with time in accordance with the speed command received. The device also includes an electronic speed control motor acting on the shiftable carriage to shift the carriage in response to the signals received from the second electronic means.

Preferably, an electric motor is mounted on the main frame above the carriage and has a reduction gear coupled to a drive shaft which, on the lower end, carries a pinion engaging a rack gear, which is permanently mounted on the carriage so that rotation of the pinion causes a lateral shifting of the carriage within the main frame.

According to the first distinguishable feature, the first sensing means allows the monitoring of the sideways position of a sheet and includes four photo-electric cells mounted on the frame and arranged on an orthogonal line corresponding to a reference line for one of the side edges of the piece. The photo-electric cells can be arranged on this line at a distance varying between −22 and −16 mm, −6 and −1 mm, +6 and +1 mm, +16 and +22 mm, respectively, with regard to the reference line. A lifting appliance is then mounted close to the same lateral edge on a bar which is permanently connected to the movable carriage.

In accordance with the preferred embodiment, the second sensing means enables the determination of the lateral position of the carriage. The second sensing means includes a magnetic detector situated in the center of the main frame adjacent to a position for the center of the carriage position and a metal flag which is carried on the carriage and coacts with this detector.

As may be easily understood, the device, according to the present invention, is particularly interesting if the procedure for correcting the lateral position of sheet-shaped pieces taken from a pile by a pick-up unit consists of shifting the piece sideways according to the indications from the sensing means as the sheet is being raised so that it is in the desired orientation for infeed onto the feed table by the conveyance appliance.

Other advantages and features of the invention will be readily apparent from the following description of the preferred embodiments, the drawings and the claims.

DESCRIPTION OF THE PREFERRED EMBODIMENTS

Figure 1:
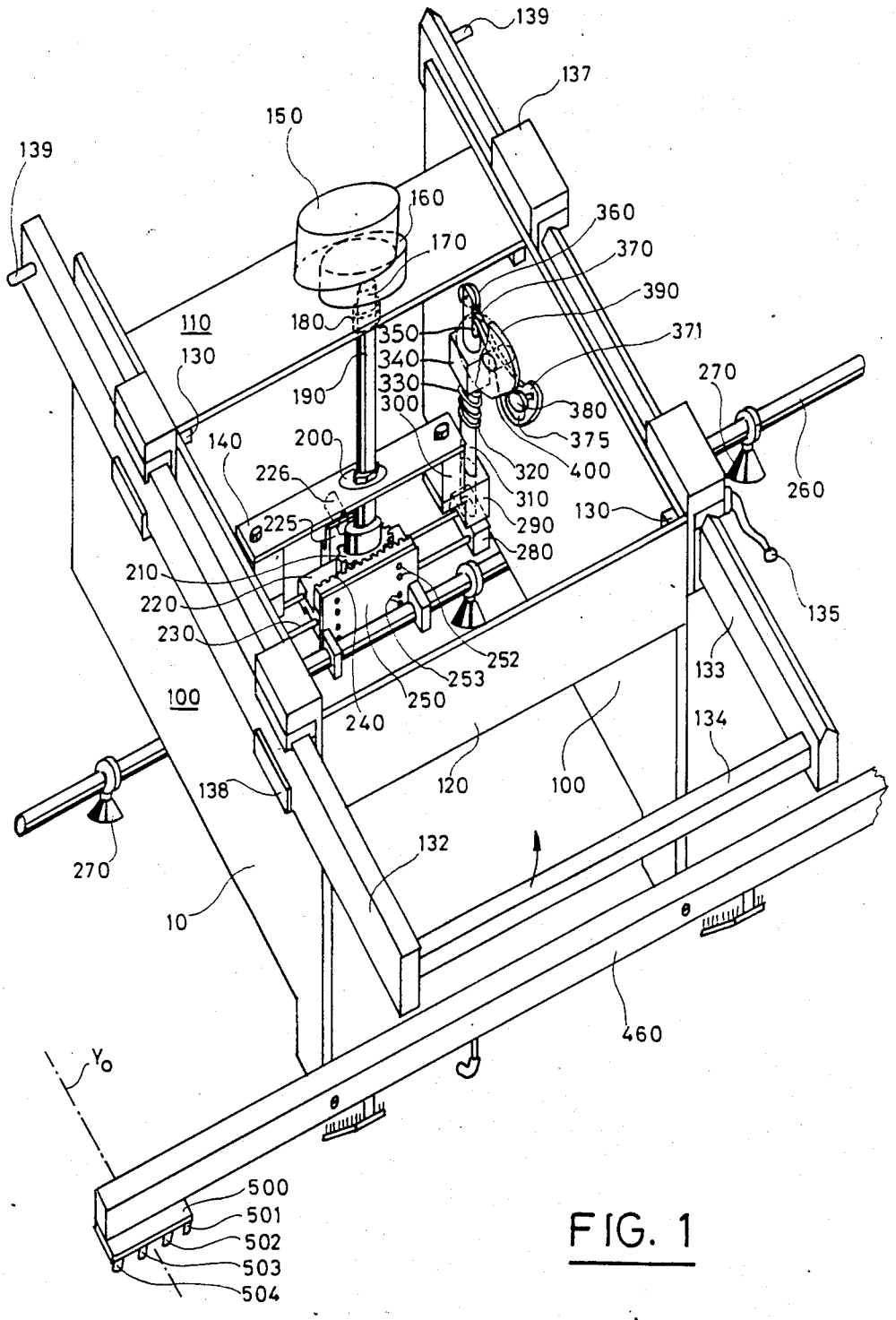
FIG. 1 is a perspective view of the device of the present invention with portions removed for purposes of illustration.

The principles of the present invention are particularly useful when incorporated in a pick-up unit having a main frame 10, as illustrated in FIG. 1. The main frame 10 has two side walls 100, which are connected to one another by an upper plate 110 and by a front plate 120. To make these connections, reinforcement corner pieces, such as 130, are utilized.

To mount the frame 10 in a main frame of the device of which the infeed station is associated, the frame is suspended by guide-type hooks 137 and 138 on two parallel longitudinal beams 132, 133 which extend in the direction of travel for the sheet as it enters the processing machine. The hooks 137 and 138 are permanently secured to the frame 10 and enable the frame 10 to be moved either forward or backward along the longitudinal beams 132, 133 once a locking handle 135 has been released. The longitudinal beams 132, 133 are attached at their rear end on the frame of the machine infeed station by means of pivots 139 and are connected on their front end by a crossbar 134, which is held on the upper structure of the infeed station by a chain and motor arrangement which allows for adequately raising and lowering the bar 134 to pivot the beams 132, 133 on pivots 139. From this arrangement, it may be seen that the position of the frame 10 can be adjusted in its height and in the sheet traveling direction, as required by the particular features of every pile of board or paper being processed.

The frame 10 has a crossbar 460 which, as illustrated, mounts a first sensing means 500 which is utilized for correcting the lateral position of a sheet as it is being raised by the device of the present invention. In addition, the crossbar 460 supports elements which are used to aid in the lifting of the topmost sheet and supports the conventional conveying arrangement or mechanism which has the arms with suction cups which are used for moving the sheet in the direction of feed from the raised position into the feeding device of the apparatus. In addition, the transmission for operating the arms of the conveying arrangement are also mounted on the bar and are driven by appropriate transmission from the main motor of the apparatus. This main motor is also provided with a power train to rotate a rotary cam 390 which is mounted for rotation on each of the side plates 100.

Once the frame 10 is in the proper position in the infeed station, the bar 460 is in the position and level for the upper pile forward edge. This bar can support appliances which insure the easy picking up of the uppermost sheet of the pile, and these appliances include air blower nozzles, pressing springs and separating brushes. Moreover, as mentioned above, a set of four reflecting photo-cells of the first sensing means are fitted on one end, which is illustrated as a left-hand end in FIG. 1.

Inside the frame 10, a carriage 220 is mounted on two parallel rails or slides 230 for movement in a sideways direction and the two rails, which are supported at each end by end blocks or crossbars 280, can be moved with the carriage in a vertical direction relative to the frame 10. The vertical movement is controlled by lifting means positioned on the inside of each of the side walls 100. A bar 260 is secured to the carriage and extends in a direction crosswise to the direction of movement of the sheets after they have been lifted. The bar 260, as illustrated, has a plurality of suction cups 270 for engaging and lifting the topmost sheet.

To raise the carriage, the two guide rails 230 and the cross members or end members 280, the lifting means is provided on each side wall 100, with only the lifting means or arrangement on the right-hand side wall being illustrated in FIG. 1. The lifting arrangement or means includes a lower bearing block 290 and an upper bearing block 340, which are secured to an inner surface of the side wall 100. A shaft or axle 310 extends through bearings formed in the blocks 340 and 290 and has a lower end engaged or coupled to a cross member 280. The shaft 310, at an upper end, is provided with a slot 350, which is closed by a roller 360. A spring 330 surrounds the shaft 310 and acts between a shoulder 320 on the shaft or rod 310 and a bottom surface of the block 340. The spring 330, thus, provides means for biasing the carriage assembly, including the cross members 280 and the guide rails 230 in a downward direction.

To raise the carriage and also control when it will move in the downward direction, a lever, which has a branch 370 extending into the slot 350 to engage a lower surface of the roller 360 and a second branch 370 supporting a cam follower or roller 380, is pivotably mounted on an axle 375 on the inner surface of the side member 100. The cam follower or roller 380 engages a periphery of the cam 390 which, as mentioned hereinabove, is mounted for rotation and is rotated in synchronous movement relative to the operation of the processing machine.

The cam 390 is a circular cam surface, except for a straight portion or flat surface 400. As illustrated, when the follower 380 is on the circular portion of the cam 390, it is moved in a position which causes a raising of the rod 310 to raise the carriage to an upper position. However, when the cam rotates so that the follower 380 engages the flat surface 400, the lever 390 can rotate in a counterclockwise position and the spring 330 will urge the shaft and carriage 220 to the lowermost position. Continued rotation of the cam will eventually have the carriage raised back as the follower 380 moves along the flat surface 400 towards the curved, circular surface. This movement will cause a raising of the carriage against the force of the spring 330.

To shift the carriage laterally, an electric motor 150, which is coupled with reduction gear 160 is mounted on the upper plate 110. An output axle or shaft 170 of the reduction gear 160 is coupled at 180 to a vertical axis or shaft 190, which is supported in a bearing 200 provided on a lower plate 140 that is mounted by a connecting part 300 to each of the bearing blocks 290. Thus, the axle or shaft 190 is in a stationary position relative to the frame 10.

On a lower end of the shaft 190, a pinion 210 is provided and engages a rack gear 240, which is mounted on the carriage 220 by a front assembly plate 250. The plate 250 is held on the carriage 220 by threaded fasteners, such as screws 253 and screws 252, hold the rack gear on the assembly plate 250.

The height of the rack gear 240 corresponds to the height of the pinion 210 plus the distance of the vertical movement for the carriage 220 when it is shifted between its uppermost position to its lowermost position. The length of the axle 190, which is to be added to the length of the pinion 210, is such that with the carriage 220 in the upper position, the pinion 210 will, at best, be flush with the upper side of the carriage. In this way, with the carriage in the lowermost position, as illustrated in FIG. 1, the pinion continues to be fully engaged with the rack gear 240. The carriage 220, on the center of its rear surface, also carries the second means for sensing the position of the carriage, which includes a metal flag 225. In addition, a magnetic proximity detector 226 is fitted on the frame 10 midway between the two side walls 100 and close to the rails 230 in such a way that it will be influenced by the position of the metal flag 225. This second sensing means will, thus, determine any lateral offset from the center position by the carriage.

As mentioned above, the first sensing means 500 includes four reflecting photo-cells 501–504, which are mounted on the bar 460, which is permanently connected to the frame 10. As illustrated, these photo-cells are mounted around an axis $Y_o$, which is the reference axis for the position expected for the sheet's side or lateral edge. Preferably, the photo-cells 501 and 502 are directed to the inside with regard to the axis $Y_o$ and at a distance between +1 and +6 mm, for example 2 mm, for the photo-cell 501 and at a distance of between +16 and +22 mm, for example +18 mm, for the photo-cell 501. The photo-cells 503 and 504 are fitted in a symmetrical manner onto the photo-cells 501 and 502 with regard to the axis $Y_o$.

Figure 2:
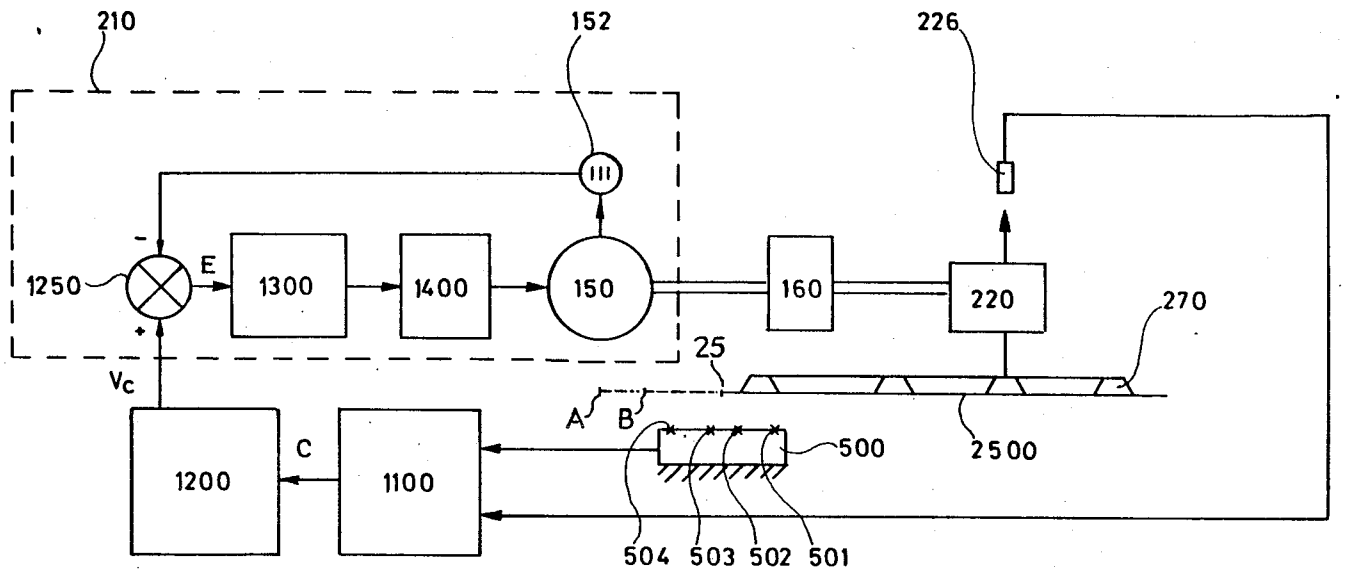
FIG. 2 is an electrical circuit diagram for the device in accordance with the present invention.

As illustrated in FIG. 2, the carriage 220 supporting the bar on which are fitted four lifting suction cups 270 is adapted to hold a sheet 2500. As held by the suction cups 270, a lateral edge 25 of the sheet 2500 which, in FIG. 2, is a left-hand edge, will be positioned relative to the four photo-cells 501–504 of the first sensing means 500. The output of these photo-cells are connected to an electronic means 1100 which will create a command C. In addition, the second sensing means formed by the magnetic proximity detector 226 has its output connected to the first electronic means 1100.

The command C from the first electronic means 1100 is applied to a second electronic means 1200 which will generate a signal $V_c$ varying in a linear manner with the time and representing the speed desired for the movement of the carriage 220. The signal $V_c$ is applied to the command input point of an electrical servomotor 1210 which actuates the carriage 220 through the motor 150 and the reduction gear 160. In a known manner, the electric servomotor includes a "B/D speed" 1300 connected to a servo-amplifier 140 which controls the electric motor 150. The speed of the electric motor is measured by a tachometer 152 which generates a counter-reactionary signal to be transmitted to a comparator 1250 which receives the command signal $V_c$ and generates the command signal E.

The device operates in the following manner. The carriage 220 is lowered by the springs 330 when the rectilinear or flat surface 400 of the cam 390 is engaged by the follower or roller 380. This causes a depression of the lifting suction cups 270 which are, thus, cause to pick up a sheet, such as 2500. As soon as the sheet 2500 begins its ascending motion, the electronic means 1100 are linked to the reflecting photo-cells 501–504. If the edge 25 of the sheet 2500 appears entirely on the left, as represented by point A or point B in FIG. 2, in such a way that its left-hand edge is situated beyond the photo-cell 504, the first electronic means 1100 will generate a command C corresponding to approximately 1800 rpm. If the edge of the sheet 2500 is situated somewhere between the photo-cell 504 and 503, the means 1100 will generate a command C corresponding to approximately 600 rpm. If the edge of the sheet 2500 is situated somewhere between the photo-cells 503 and 502, the sheet position can be considered as correct and the means 1100 will generate a zero or nil command signal. Symmetrically, the command signal C corresponding to a −600 rpm is generated if the edge of the sheet is situated between the photo-cells 502 and 501 and a command signal corresponding to −1800 rpm will be created if the edge is situated beyond or towards the right-hand side of the reflecting photo-cell 501. Obviously, as the position of the sheet is corrected by the lateral shifting of the carriage 220 during the ascent of the sheet, the command C will change accordingly. As shown by the example illustrated by FIGS. 3*a* and 3*b*, the sheet sets off from an excessive left-hand position of either A or B before successively traveling through under the photocells 504 and 503. The electronic means 1100 will, thus, generate a step-shaped signal of command C, i.e., with 1800 rpm in the first phase, 600 rpm in the second phase, and a nil or zero rate speed in the last phase.

Figure 3A:
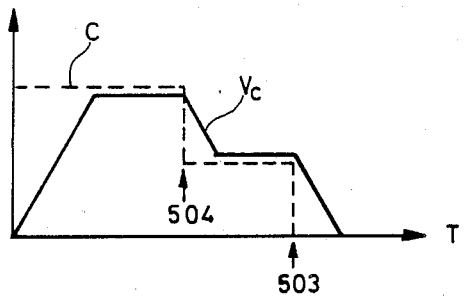
FIGS. 3*a* and 3*b* are diagrams illustrating the development of the speed command C, which is shown in dash lines, and of the orders $V_c$, which are shown in bold lines, corresponding to time, with FIG. 3*a* showing a greater initial lateral offset relative to a reference line than the offset for the diagram of FIG. 3*b*.
Figure 3B:
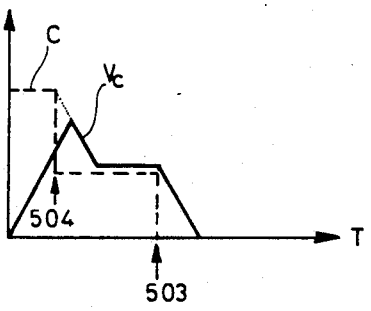

These commands are transformed by the second electronic means 1200 to limit the acceleration and deceleration of the device to fixed rates. To present an example, the acceleration rate corresponds to a transition from 0 rpm to 1800 rpm is 38 ms and the deceleration rate to a transition from 1800 rpm to 0 rpm is approximately 48 ms. In this way, and as illustrated in FIG. 3*a*, the speed command $V_c$ corresponds to 1800 rpm proceeds in a linear way from 0 rate to a rate $V_c$ corresponding to 1800 rpm. This latter rate is maintained until the lateral edge of the sheet 2500 travels through or to a point where it is between the photo-cells 504 and 502. Once the new command C=600 rpm has been demanded, a ramp generator of the second electronic means 1200 will reduce the command $V_c$ in a linear way until this new speed rate will be obtained. This new speed rate being maintained until the edge travels to a position that is somewhere between the photo-cell 503 and 502. Once the edge reaches this position, the generator of the second electronic means 1200 diminishes the rate $V_c$ in a linear way to a zero or nil rate. In cases where initially the sheet edge is at point B, which is slightly only to the left of the photo-cell 504, the deceleration, as illustrated in FIG. 3*b*, will occur, although the command speed $V_c$ has not obtained the first rate corresponding to 1800 rpm.

Owing to its speed counter-reaction, the servo-motor 1210 is able to respond to the commands $V_c$ that are applied thereto and, accordingly, shift the carriage 220 by means of the reduction gear 160.

Once the sheet has been centered and then released for the conveyor system to transport it into the feed station, the carriage 220 is likely to be slightly displaced from its center line position within the frame 10. This displacement is a direct consequence of the initial displacement during the last sheet pick-up. The electronic means 1100, after release of the sheets, are then linked to the magnetic proximity receiver 226. Depending on the direction of displacement, i.e., whether the carriage is on the right or to the left of the center line position, this electronic means 1100 will generate a equal command of +/−1800 rpm to be transmitted to the ramp generator of the second electronic means 1200 for the generation of a signal $V_c$, which is to increase in a linear manner. The carriage is then moved back to its initial center line position, whereupon the operation cycle can begin again with the next sheet in the pile.

There are possibilities to add numerous improvements to the above-mentioned device within the limits of this invention. For example, a twin design of the device having a front unit and rear unit with regard to the sheet traveling direction will allow a correction of both the position of the lateral edge of the sheet with respect to a reference line and also obtain a parallelism of this edge with regard to the reference axis or line.

Although various minor modifications may be suggested by those versed in the art, it should be understood that I wish to embody within the scope of the patent granted hereon all such modifications as reasonably and properly come within the scope of my contribution to the art.

I claim:

1. A device constructed for correcting a lateral position of a sheet-shaped piece taken from the top of a pile of sheet-shaped pieces by a pick-up unit within a machine infeed station, said pick-up unit being arranged within a fixed frame and including means for lifting the piece from the pile, as well as conveying means for carrying the piece into the machine after it is released by the lifting means, said device including a carriage being mounted in the frame for both lateral and vertical movement and having the lifting means permanently secured to the carriage, a first sensing means for determining the lateral position of the piece, second sensing means for determining the lateral position of the carriage in the frame, means for vertically shifting the carriage in accordance with a machine operating cycle, means for laterally shifting the carriage in response to indications originating from the first sensing means during upward movement of the carriage and for shifting the carriage in response to the second sensing means during a downward movement of the carriage.

2. A device according to claim 1, wherein the carriage is shiftable on two horizontal rails secured at each end by cross members, said means for vertically shifting the carriage including a vertical shaft secured to each of the cross members, said vertical shaft being mounted by bearings for vertical movement relative to a wall of the frame, means biasing the shaft and carriage downward to a lowermost position, each shaft having a portion engaged by a branch of a lever, said lever being mounted for rotation on a side wall of the frame and having a follower engaging a cam mounted for rotation on said side wall, said cam being rotated in accordance with the machine operating cycle of the main machine and causing a raising of the shaft and carriage to the uppermost position against the means biasing the carriage to the lowermost position.

3. A device according to claim 2, wherein the means for laterally shifting the carriage includes an electric motor being secured on said frame, said motor being connected to a drive shaft through a reduction gear, said drive shaft having a pinion at one end engaging a rack gear secured to said carriage for shifting the carriage along said horizontal rails.

4. A device according to claim 1, wherein the means for shifting the carriage laterally includes a first electronic means generating a speed command in compliance with indications received from the first sensing means for adjusting the position of a sheet being lifted by the carriage, and receiving signals from the second sensing means enabling adjusting the carriage position, a second electronic means receiving the speed command and creating a continuous signal varying in linear manner as required by the speed command, an electric speed controlled electrical motor acting on the lateral position of the carriage in accordance with the speed command from said second electronic means.

5. A device according to claim 4, which includes the electrical motor being mounted on the frame above the carriage, said motor driving a reduction gear having an output shaft connected to a vertically positioned drive shaft, said drive shaft having a pinion at one end engaging a rack gear secured to said carriage so that rotation of said shaft shifts the carriage laterally relative to said frame

6. A device according to claim 1, wherein the first sensing means comprises four reflecting photo-cells arranged on a line extending at right angles to a reference line for one lateral edge of the piece, with the distance from the line of the first photo-cell being between +16 and +22 mm, the distance of the next photo-cell being between +1 and +6 mm, the distance of the third photo-cell being between −1 and −6 mm, and the distance between the fourth being −16 and −22 mm, said carriage having a bar extending transverse to the lateral edge, said bar having at least one lifting means close to said lateral edge.

7. A device according to claim 1, wherein the second sensing means comprises a magnetic detector being situated in the center of the frame close to the carriage, a metal flag being disposed on said carriage and coacting with said metal detector to determine the lateral position of the carriage relative to said frame.

* * * * *